United States Patent [19]

Nishihara et al.

[11] Patent Number: 4,921,363

[45] Date of Patent: May 1, 1990

[54] THERMAL TRANSFER PRINTER HAVING INDEPENDENT CARRIAGE SCANNING MECHANISM AND RIBBON WINDING MOTOR

[75] Inventors: Testuo Nishihara, Osaka; Takashi Watanabe; Tomotaroh Tohjyoh, both of Nara, all of Japan

[73] Assignee: Sharp Kabushiki Kaisha, Osaka, Japan

[21] Appl. No.: 330,930

[22] Filed: Mar. 27, 1989

Related U.S. Application Data

[63] Continuation of Ser. No. 106,027, Oct. 8, 1987, abandoned, which is a continuation of Ser. No. 818,137, Jan. 13, 1986, abandoned.

[30] Foreign Application Priority Data

| | | | |
|---|---|---|---|
| Jan. 26, 1985 | [JP] | Japan | 60-12864 |
| Jan. 26, 1985 | [JP] | Japan | 60-12865 |
| Jan. 26, 1985 | [JP] | Japan | 60-12866 |
| Jan. 26, 1985 | [JP] | Japan | 60-12867 |
| Jan. 26, 1985 | [JP] | Japan | 60-12868 |

[51] Int. Cl.[5] ..... B41J 3/20

[52] U.S. Cl. ..... 400/120; 400/208; 400/225; 400/229; 400/249; 346/76 PH

[58] Field of Search ..... 400/120, 194, 195, 196, 400/196.1, 207, 208, 208.1, 225, 229, 249; 346/76 PH

[56] References Cited

U.S. PATENT DOCUMENTS

| | | | |
|---|---|---|---|
| 4,146,338 | 3/1979 | Hedstrom | 400/208 X |
| 4,456,392 | 6/1984 | Nozaki et al. | 400/120 |
| 4,468,139 | 8/1984 | Hattori | 400/120 |
| 4,511,903 | 4/1985 | Miyazaki et al. | 400/120 X |
| 4,516,137 | 5/1985 | Yasui | 400/120 X |
| 4,563,692 | 1/1986 | Negita et al. | 400/120 X |
| 4,652,154 | 3/1987 | Horiya et al. | 400/120 |

FOREIGN PATENT DOCUMENTS

| | | | |
|---|---|---|---|
| 0077218 | 4/1983 | European Pat. Off. | 400/208 |
| 0063494 | 4/1983 | Japan | 400/208 |
| 0102782 | 6/1983 | Japan | 400/208 |
| 009889 | 6/1984 | Japan | 400/208 |

OTHER PUBLICATIONS

IBM Technical Disclosure Bulletin, "Optical Means for End-of-Ribbon Sensing", Bullock et al, vol. 23, No. 9, Feb. 1981, pp. 3955-3956.

IBM Technical Disclosure Bulletin, "End-of-Ribbon Sensor and Cartridge-Present Indicator", Jenkins, vol. 27, Nov. 1984, pp. 3645-3646.

*Primary Examiner*—Ernest T. Wright, Jr.

*Attorney, Agent, or Firm*—Birch, Stewart, Kolasch & Birch

[57] ABSTRACT

An improved thermal transfer printer which is so arranged that a winding motor for driving a transfer ribbon winding device in synchronization with a carriage motor is mounted on the carriage separately from the carriage motor so as to reduce the load applied onto the carriage motor, with simultaneous elimination of an engaging mechanism between a carriage scanning mechanism and the ribbon winding device.

3 Claims, 8 Drawing Sheets

THERMAL TRANSFER PRINTER HAVING INDEPENDENT CARRIAGE SCANNING MECHANISM AND RIBBON WINDING MOTOR

This application is a continuation, of application Ser. No. 07/106,027 filed on Oct. 8, 1987, now abandoned, which is a continuation of application Ser. No. 06/818,137 filed on Jan. 13, 1986, now abandoned.

BACKGROUND OF THE INVENTION

The present invention generally relates to a thermal transfer printer and more particularly, to a supply arrangement of a thermal transfer ribbon for a serial thermal transfer printer so arranged that a carriage detachably mounted with a thermal transfer ribbon cassette is subjected to a horizontal scanning with respect to a recording paper. The thermal transfer printer is capable of selectively effecting a transfer recording onto plain paper through mounting of the thermal transfer ribbon cassette, or a recording onto a heat sensitive paper without mounting the thermal transfer ribbon cassette.

Conventionally, in the thermal transfer printer as referred to above, it has been so arranged that the thermal transfer ribbon fed out from a supply spool is brought into pressure contact with the recording paper between a thermal head and the recording paper. The thermal transfer ribbon is subsequently wound onto a winding spool which is engaged with a scanning mechanism of a carriage for rotation to take up the thermal transfer ribbon thereon. There have not been provided means for detecting the presence or absence of the thermal transfer ribbon, or means for controlling heat generating temperatures for the thermal head according to the result of the detection by the detecting means.

In the known thermal transfer printer as described so far, however, since the carriage motor serves as a driving source for the displacement of the carriage and also for winding the thermal transfer ribbon, the load becomes undesirably large, with a consequent requirement for a motor of a large size. Moreover, the engaging mechanism between the scanning mechanism of the carriage and the winding spool tends to be complicated, and readjustments are frequently required by the characteristic changes of mechanical elements such as springs, wires, etc. through operations for long periods of time. Meanwhile, in the prior art thermal transfer printer as described above, since the thermal transfer ribbon winding means is not required to be driven during recording onto the heat sensitive paper, it becomes necessary to provide means for releasing engagement thereof with the carriage scanning means, thus also resulting in a further complication of the engaging mechanism. Besides, since no means are provided for controlling heat generating temperatures of the thermal head through detection of whether or not the thermal transfer ribbon is attached, there has been such a problem that it is difficult for the thermal head to achieve a proper temperature during either one of the thermal transfer print mode or the recording mode using heat sensitive paper, or during both of these modes.

Furthermore, in the conventional thermal transfer printer, owing to the arrangement that the transfer ribbon winding means is rotated through engagement with the scanning mechanism driven by the carriage motor, upon stopping displacement of the carriage according to the completion of recording, the transfer ribbon winding means stops rotating, and in this case, if the winding of the transfer ribbon is suspended before completion of spacing of the thermal head from the recording paper, the transfer ribbon tends to be loosened or slackened when the thermal head has been completely spaced from the recording paper.

Another disadvantage inherent in the known thermal transfer printer is such that, since it is so arranged that a pressure contact mechanism of the thermal head is driven at the start of the recording so as to bring the thermal head into pressure contact with the recording paper, and thereafter, the carriage motor is driven to displace the carriage, with the transfer ribbon winding means being rotated by said carriage motor, the winding of the transfer ribbon is effected after completion of the pressure contact of the thermal head, but is not effected during functioning for the pressure contact of the thermal head, and thus, slackening of the transfer ribbon takes place in this case also.

SUMMARY OF THE INVENTION

Accordingly, an essential object of the present invention is to provide an improved thermal transfer printer which is so arranged that a thermal transfer ribbon winding motor, independent of a carriage scanning mechanism, is mounted on a carriage for exclusively winding the thermal transfer ribbon for substantial elimination of disadvantages inherent in the conventional thermal transfer printers as referred to earlier.

Another important object of the present invention is to provide a thermal transfer printer of the above described type in which driving of the thermal transfer ribbon winding motor is controlled through detecting the presence or absence of the thermal transfer ribbon as mounted so that when the ribbon is not mounted, the winding motor can not be driven for winding purposes.

A further object of the present invention is to provide a thermal transfer printer of the above described type in which there is provided a control means for controlling the heat generating temperature of the thermal head by detecting the presence or absence of a transfer ribbon cassette as mounted so as to change-over the heating temperature of the thermal head between the thermal transfer print mode and the recording mode to a heat sensitive paper, for providing the temperature suitable to each case.

Still another object of the present invention is to provide a thermal transfer printer of the above described type in which the thermal transfer ribbon winding motor provided independently of the carriage scanning mechanism is rotated until completion of spacing of the thermal head from the recording paper so as to be stopped in rotation after complete spacing of the thermal head therefrom to prevent the slackening of the transfer ribbon.

A still further object of the present invention is to provide thermal transfer printer of the above described type in which the thermal transfer ribbon winding motor provided independently of the carriage scanning mechanism is controlled to be driven before the thermal head contacts the recording paper under pressure at the start of recording. In other words, in the course of the functioning for the pressure contact so as to prevent the transfer ribbon from slackening, the carriage motor is controlled to be driven in synchronization with the winding motor during pressure contact of the thermal head onto the recording paper so as to prevent the slackening of the transfer ribbon at the start of recording.

In accomplishing these and other objects, according to one preferred embodiment of the present invention, there is provided a thermal transfer printer which has a carriage provided thereon with a supply means and a winding means for a thermal transfer ribbon and a thermal head which effects transfer onto a recording paper for recording by heat generation, with the carriage being arranged to be displaced by a carriage motor in a direction intersecting at right angles with a recording paper feeding direction for recording through the thermal transfer ribbon, and which comprises a transfer ribbon cassette detachably mounted on the carriage and accommodating therein a ribbon supply spool and a ribbon winding spool respectively engaged with said supply means and said winding means and the thermal transfer ribbon passed around said supply spool and winding spool, a cassette detecting means provided on the carriage for detecting mounting of the transfer ribbon cassette, and a winding motor provided independently of said carriage motor so as to drive the winding means in synchronization with said carriage motor, whereby the driving of said winding motor is controlled according to the detection by said cassette detecting means so as not to rotate said winding means when the transfer ribbon cassette is not mounted.

There is also provided a control means for changing-over heat generating temperatures of said thermal head according to the detection by said cassette detecting means, so as to set the heat generating temperature of said thermal head during a transfer recording period mounted with said cassette, lower than that during the recording period onto a heat sensitive paper, not mounted with said cassette.

The above thermal transfer printer according to the present invention further includes a pressure contact/-spacing mechanism for selectively contacting the thermal head under pressure with the recording paper or spacing said thermal head therefrom, and a control circuit means which effects control in such a manner that it drives said pressure contact/spacing mechanism for the thermal head in synchronization with the rotation of said winding motor until completion of a recording, and continuously rotates said winding motor until completion of spacing of said thermal head so as to stop rotation of said winding motor after the completion of the spacing and for driving said carriage motor thereafter.

Further provided in the above thermal transfer printer of the present invention is a control circuit means which effects control in such a manner that it drives said pressure contact/spacing mechanism for the thermal head so as to bring said thermal head into pressure contact with the recording paper at the start of recording, with said winding motor being started before the pressure contact of said thermal head, with said carriage motor and said winding motor being driven in synchronization with each other during said pressure contact.

By the arrangement according to the present invention as described above, advantages as follows are available.

(i) By providing on the carriage, the winding motor for driving the transfer ribbon winding means in synchronization with the carriage motor, independently of said carriage motor for displacing the carriage, the load for the carriage motor is reduced, while the engaging mechanism between the carriage scanning mechanism and ribbon winding means has been made unnecessary.

(ii) By the control means for controlling the winding motor, carriage motor and thermal head functioning motor, the transfer ribbon can be prevented from slackening.

(iii) By changing-over the heat generating temperature of the thermal head according to presence or absence of the transfer ribbon cassette as mounted, the temperature of the thermal head may be maintained at a proper level both for the thermal transfer recording by the transfer ribbon, and for the recording onto a heat sensitive paper.

BRIEF DESCRIPTION OF THE DRAWINGS

These and other objects and features of the present invention will become apparent from the following description taken in conjunction with the preferred embodiments thereof with reference to the accompanying drawings, in which.

DETAILED DESCRIPTION OF THE INVENTION

Figure 1:
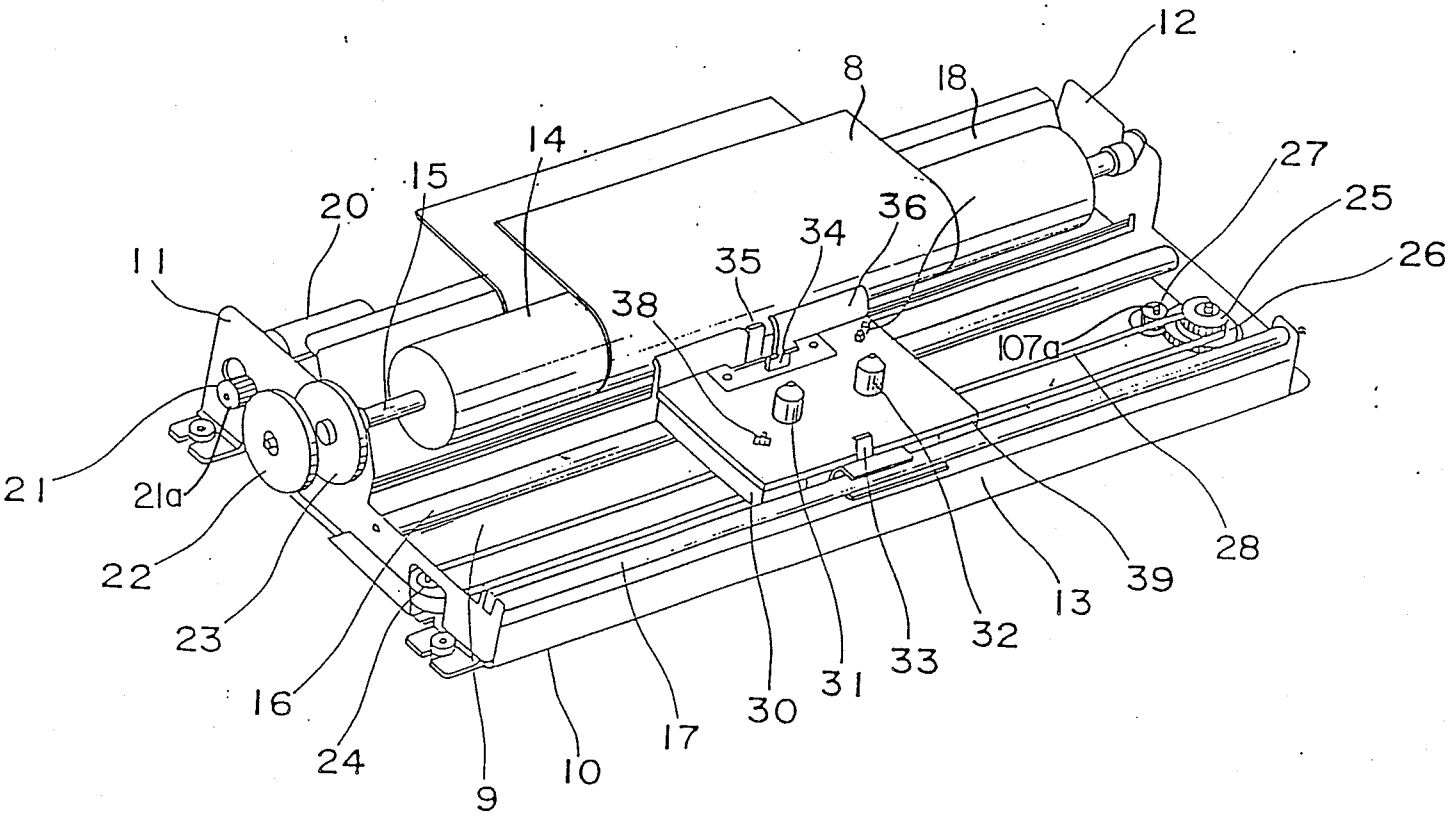
FIG. 1 is a perspective view of a thermal transfer printer according to one preferred embodiment of the present invention.

Before the description of the present invention proceeds, it is to be noted that like parts are designated by like reference numerals throughout the accompanying drawings.

General construction (FIG. 1)

Referring now to the drawings, there is shown in FIG. 1, a thermal transfer printer according to one preferred embodiment of the present invention, which generally includes a chassis 10, a platen 14 rotatably provided along one side of the chassis 10, a paper feeding motor 20, and a carriage 30 to be described in more detail later and provided with a ribbon supply reel 32, a ribbon winding reel 31, a thermal head 35, a ribbon end sensor 37 composed of a photoelectric element, an actuating lever 38 projecting through a carriage cover plate 39 and associated with a cassette mounting sensor 70 composed of a microswitch (FIG. 2) provided in the carriage 30.

The chassis 10 of a generally rectangular configuration includes a base portion 9, side walls 11 and 12 extending upwardly from opposite sides of the base portion 9, and a front panel 13 also extending upwardly from the front side of said base portion 9, with rear half portions of said side walls 11 and 12 being formed to be higher than front half portions thereof. The platen 14 is rotatably supported, at opposite ends of its shaft 15, by the rear half portions of said side walls 11 and 12, while a pair of guide shafts 16 and 17 for guiding the carriage 30 to travel therealong are fixed, at opposite ends thereof, to the front sides of said side walls 11 and 12 so that said shafts 16 and 17 are laterally supported in a parallel and spaced relation to each other. A lower paper guide plate 18 is also supported by the side walls 11 and 12 to extend from the lower portion of the platen 14 toward its rear portion through a predetermined interval from the surface of said platen 14, while at the back of said guide plate 18, the paper feeding motor 20 consisting of a stepping motor is fixed to the side wall 11. A motor gear 21 is fixed on a rotary shaft 21*a* of said motor 20 extending outwardly from the side wall 11, and is engaged with one of idler gears 22 of a double construction. The other gear (not shown) of said idler gears 22 is in mesh with a platen gear 23 fixed to the corresponding end of said platen shaft 15, whereby the platen 14 is rotated through rotation of the paper feeding motor 20 for feeding a recording paper 8 in a vertical direction. The recording paper 8 may be either plain or heat sensitive.

Between the guide shafts 16 and 17 described above, in a relation parallel therewith, a timing belt 28 is passed around pulleys 24 and 25 respectively provided on the base portion 9, with the opposite ends of said timing belt 28 being secured to the carriage 30. The pulley 25 is integrally formed with an idler gear 26, which is engaged with a motor gear 27 fixed to a rotary shaft 107(*a*) of a carriage motor 107 (FIG. 5) consisting of a stepping motor and provided on the chassis 10.

Accordingly, the timing belt 28 is moved through rotation of the idler gear 26 and pulley 25 by the rotation of the carriage motor 107, and according to the movement of said timing belt 28, the carriage 30 is subjected to reciprocating movements along the guide shafts 16 and 17. In FIG. 1, recording to the recording paper 8 is effected during movement of the carriage 30 in the rightward direction.

Construction of carriage cover (FIG. 1)

Figure 4:
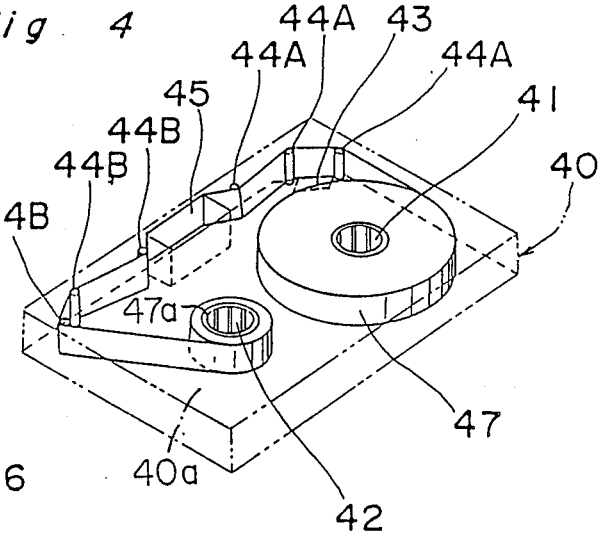
FIG. 4 is a perspective view of a thermal transfer ribbon cassette to be applied to the printer of FIG. 1.

Through the cover plate 39 which covers the open upper face of the carriage 30 in a rectangular flat box-like configuration, the ribbon supply reel 32 and ribbon winding reel 31 project from a gear box 30B formed internally of said carriage 30. From the rear side of said cover plate 39, a paper guide plate 36 extends upwardly to have an arcuate cross section concentric with the peripheral surface of said platen 14. The cover plate 39 is arranged to have mounted thereon a transfer ribbon cassette 40 as shown in FIG. 4, and guide members 33 and 34 for mounting the cassette 40 are provided to project from central portions of the front and rear sides of the cover plate 39, with the forward guide member 33 being formed by a plate spring. Moreover, the ribbon end sensor 37 consisting of a photoelectric element is provided to project through the cover plate 39 so as to be inserted into the ribbon cassette 40 to be mounted for detection thereof, for example, through utilization of the light transmitting property of the ribbon end portion 47A. Furthermore, the actuating lever 38 of the cassette mounting sensor 70 provided within the gear box 30B formed internally of carriage 30 is also adapted to project through the cover plate 39 from the lower portion so that the cassette mounting is detected by the function of the sensor 70 through contact of said actuating lever 38 with the bottom plate 40(*a*) of the cassette 40 to be mounted, while the non-mounting of the cassette 40 is detected when the lever 38 is not actuated.

Figure 3:
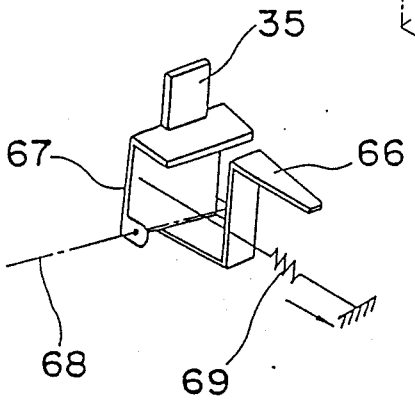
FIG. 3 is a perspective view showing on an enlarged scale, a thermal head employed in the printer of FIG. 1.

Description of the thermal head (FIG. 3)

The thermal head 35 in the shape as shown in FIG. 3 is mounted on the carriage 30. More specifically, a head support plate 67 of the thermal head 35 is mounted on the carriage 30 through an axis 68 for rotation about said axis 68, while a spring 69 is stretched between the support plate 67 and the carriage 30 so as to urge the thermal head 35 in a direction indicated by an arrow in FIG. 3, i.e., in the direction away from the platen 14. A head slider 66 having a generally L-shaped cross section is fixed to the head support plate 67, and by vertically moving said head slider 66 with a driving unit 61 (to be described later) provided in the carriage 30, the thermal head 35 is brought into complete pressure contact with the platen 14 at the uppermost position of the head slider 66, while the head 35 is spaced away from the platen 14 at the lowermost position thereof.

Construction of transfer ribbon cassette (FIG. 4)

In the transfer ribbon cassette 40 to be mounted on the carriage cover plate 39, a ribbon supply spool 41 wound with a transfer ribbon 47 and engaged with the ribbon supply reel 32, and a ribbon winding spool 42 engaged with the ribbon winding reel 31, are rotatably supported. The transfer ribbon 47 wound around said ribbon supply spool 41 and led out from said supply spool 41 passes through a cut-out portion 45 in which the thermal head 35 and the guide member 34 are inserted, via three guide pins 44A, and is subsequently taken up onto the winding spool 42 through three guide pins 44B. Accordingly, by rotating the winding spool 42 in the counterclockwise direction through rotation of the ribbon winding reel 31, the transfer ribbon 47 is led out from the supply spool 41 into the cut-out portion 45, i.e., into the recording portion. The cassette 40 is formed in its bottom plate 40(*a*), with a hole 43 through which the ribbon end sensor 37 referred to earlier is inserted into the cassette 40.

Figure 2:
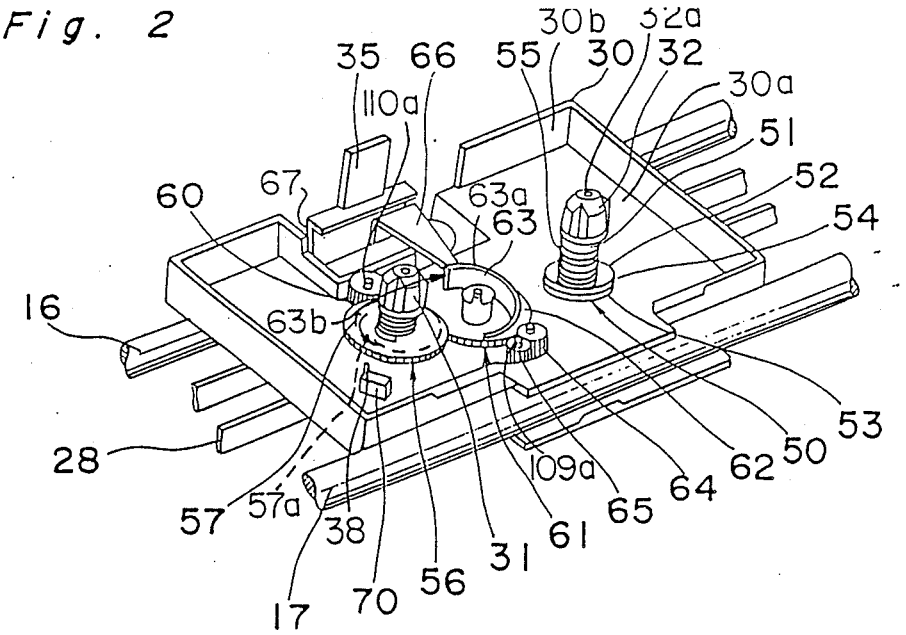
FIG. 2 is a perspective view showing on an enlarged scale, the internal construction of a carriage employed in the thermal transfer printer of FIG. 1.

Internal construction of carriage (FIG. 2)

In the carriage 30, there are provided a supply reel unit 50, a winding reel unit 56 and a pressure contact/-spacing mechanism, i.e., a driving unit 61 provided between said reel units 50 and 56 for selectively contacting or spacing the thermal head 35 with respect to the platen 14 and consequently, to the recording paper 8.

The supply reel unit 50 includes a reel shaft 51, clutch plates 52 and 53 having a felt member 54 sandwiched therebetween, and a spring 55, with the supply reel 32 referred to earlier being formed by extending the upper portion of the reel shaft 51. The supply reel 32, reel shaft 51 and clutch plate 53 are integrally formed, and are rotatably supported by an inner shaft 32A erected on the base plate 30(*a*) of the carriage 30. Meanwhile, the other clutch plate 52 is pressed against the clutch plate 53 by the spring 55 so as to be fixed without rotating, to thereby constitute a tension mechanism for the reel 32. Accordingly, the supply spool 41 of the cassette 40 is rotated by overcoming the frictional force of the felt member 54 when the transfer ribbon 47 is led out. Moreover, by the friction of the felt member 54, supply of an extra amount of the transfer ribbon 47 due to rotation by inertia is prevented. The ribbon winding reel 31 also has the similar construction to the above supply reel 32, but the clutch plate 52 in the supply reel 32 is replaced by a winding gear 57. This winding gear 57 is engaged with a motor gear 60 mounted on a rotary shaft 110(*a*) of a winding motor 110 (FIG. 5) consisting of a stepping motor and mounted on the carriage 30 through an idler gear 57*a* located at the back of the winding gear 57. Therefore, by the clockwise rotation of said winding motor 110, the winding gear 57 is rotated in the direction of the arrow, and the ribbon winding spool 42 is rotated in the counterclockwise direction through the winding reel 31, with said winding spool 42 being driven in synchronization with the carriage motor 107 for displacing the carriage 30.

The rotation of the above winding gear 57 has a torque larger than an adhering force by which the transfer ribbon 47 adheres to the paper 8 for recording so as to pull off the ribbon 47 and also to prevent slackening of said ribbon 47. Meanwhile, the amount of rotation of said winding gear 57 is set to be larger than the amount of rotation of the carriage motor 107, i.e., the amount of displacement of the carriage 30. Although the winding of the transfer ribbon 47 is suppressed by the pressure contact of the thermal head 35 with respect to the platen 14, since the winding motor 110 has an amount of rotation larger than that of the carriage motor 107, the winding gear 57 is idly rotated by overcoming the frictional force of the felt member 54 for the winding reel unit 56. Accordingly, the frictional force of this felt member 54 must be set to be larger than the adhering force of the transfer ribbon 47, but smaller than the pressure contact force of the thermal head 35 so that the transfer ribbon 47 does not unnecessarily slide over the recording paper 8.

In the driving unit 61 for contacting or spacing the thermal head 35 with respect to the platen 14, a cam gear 62 is rotatably journalled on the carriage bottom plate 30*a*, while gear teeth are formed on the peripheral face of the cam gear 62, with a cylindrical cam 63 being further formed on the upper surface of said cam gear 62. The gear teeth of the cam gear 62 are engaged, through an idler gear 64, with a motor gear 65 provided on a rotary shaft 109(*a*) of a head functioning motor 109 (FIG. 5—not shown in FIG. 2) consisting of a stepping motor and mounted on the bottom portion 30*a* of the carriage 30. The forward end of head slider 66 integral with said thermal head 35 is held in pressure contact with the cam protrusion 63*a* of said cylindrical cam 63. The cam protrusion 63*a* is gradually increased in its height to provide a sharp notched portion 63*b* subsequent to its highest position, and when the head slider 66 is located at the highest position of the cam protrusion 63*a* through rotation of the cam gear 62, the thermal head 35 is brought into pressure contact with the platen 14, and when said head slider 66 is positioned at the lowest position (i.e., on the flat surface of the cam gear 62), the thermal head 35 is spaced away from the platen 14. Simultaneously, as described earlier, the thermal head 35 is urged to be spaced from the platen 14 by the spring 69.

In the above construction, during the recording, by rotating the head functioning motor 109, the thermal head 35 is brought into pressure contact with the platen 14, while during non-recording periods such as the returning and spacing periods, by further rotating the head functioning motor 109, the thermal head 35 is rapidly spaced from the platen 14 so as to displace the carriage 30, with the above state maintained. Meanwhile, within the carriage 30, the cassette mounting sensor 70 referred to earlier and consisting of a microswitch for detecting the mounting of the transfer ribbon cassette 40 is provided, with its actuating lever 38 projecting through the carriage cover 39. By the function of said cassette mounting sensor 70, change-over is effected between the control of recording by utilizing the thermal transfer ribbon 47 and the control of recording through the recording paper 8 of a heat sensitive type, and the driving of the winding motor 110 is adapted to be suspended when the cassette 40 is not mounted.

Figure 5:
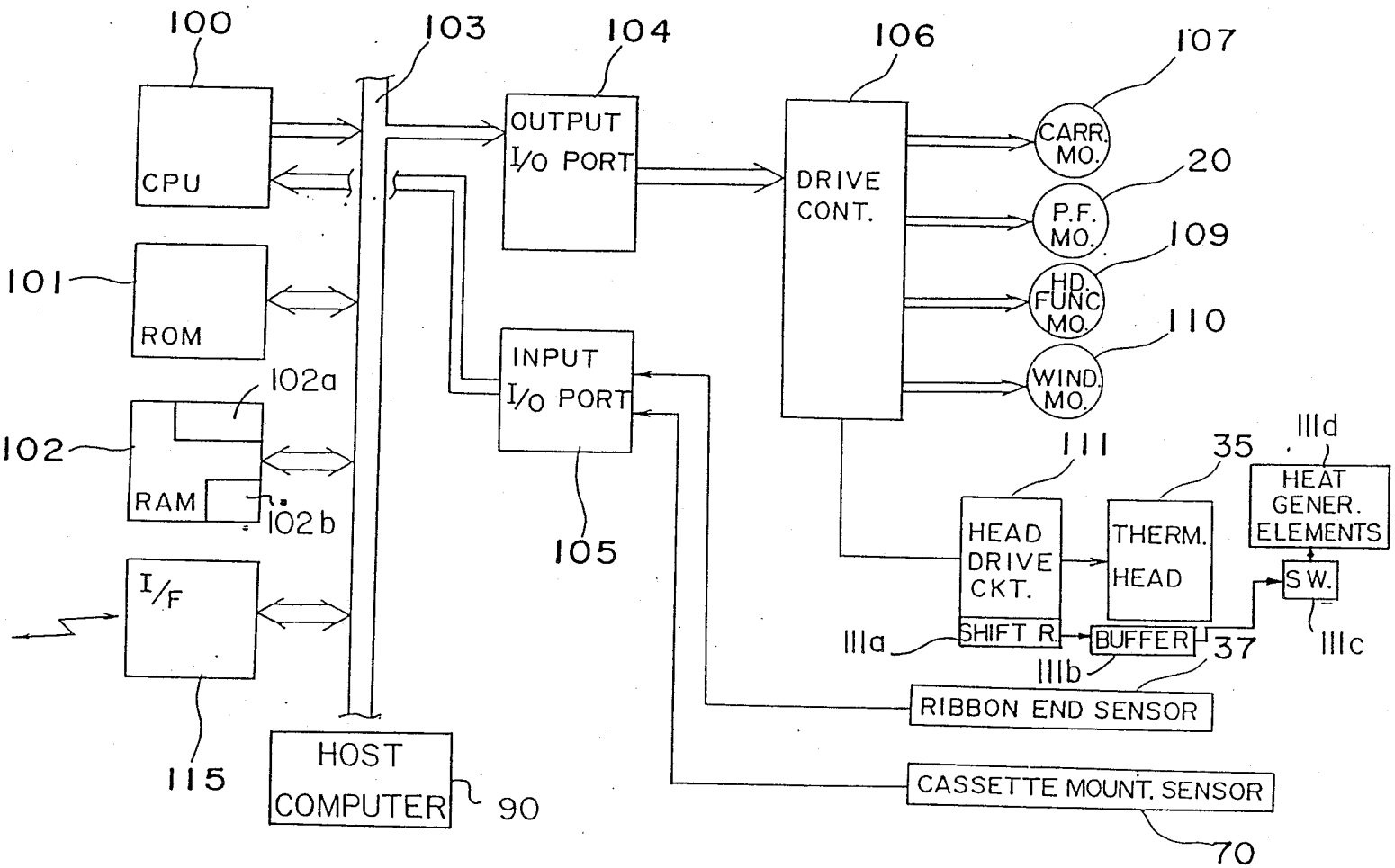
FIG. 5 is an electrical block diagram showing the circuit construction of the thermal transfer printer of FIG. 1.

Circuit construction (FIG. 5)

Referring also to FIG. 5, the construction of the system control circuit for the thermal transfer printer according to the present invention will be explained hereinafter.

The system control circuit shown in FIG. 5 generally includes a CPU (central processing unit) 100, a ROM (read only memory) 101, a RAM (random access memory) 102, an interface 115, an output I/O port 104, and an input I/O port 105 which are all connected to a system bus 103, a drive control 106 connected to the output I/O port 104 and also to the carriage motor 107, paper feeding motor 20, head functioning motor 109, winding motor 110 and further to the thermal head 35 through a head drive circuit 111, with the ribbon end sensor 37 and cassette mounting sensor 70 being coupled to the input I/O port 105 as shown.

Figure 6A:
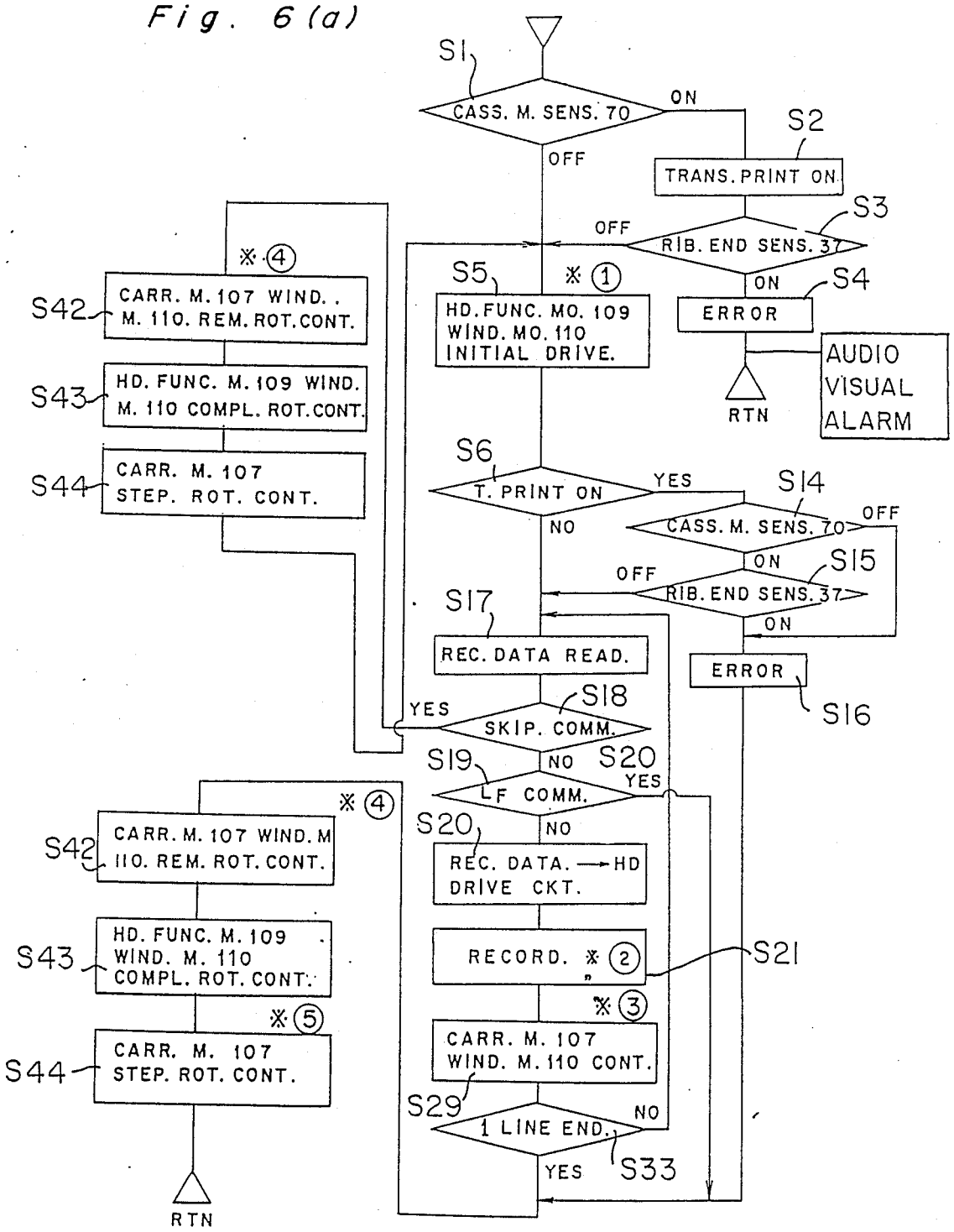
FIGS. 6(*a*) through 6(*3*) are flow-charts showing sequence of functions of the thermal transfer printer of the present invention.
Figure 6C:
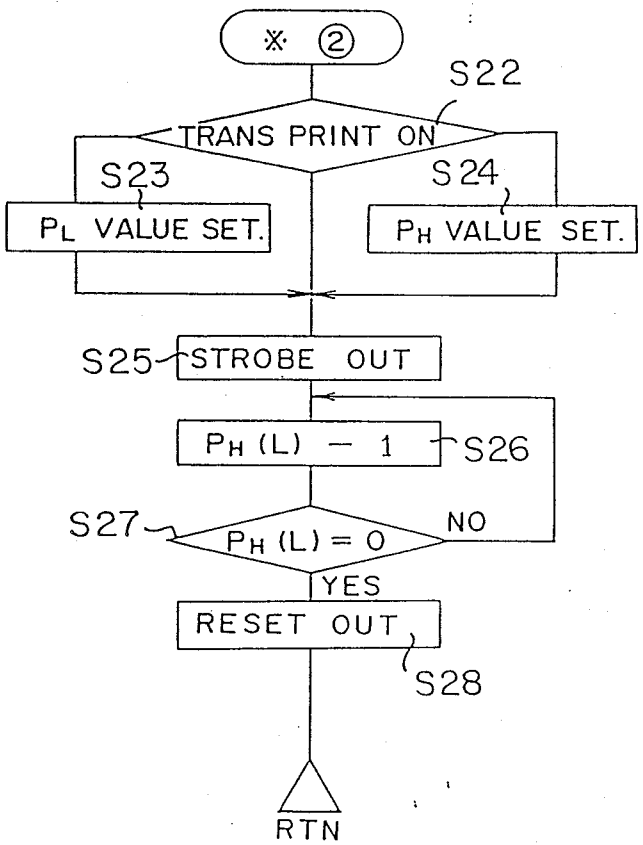
Figure 6B:
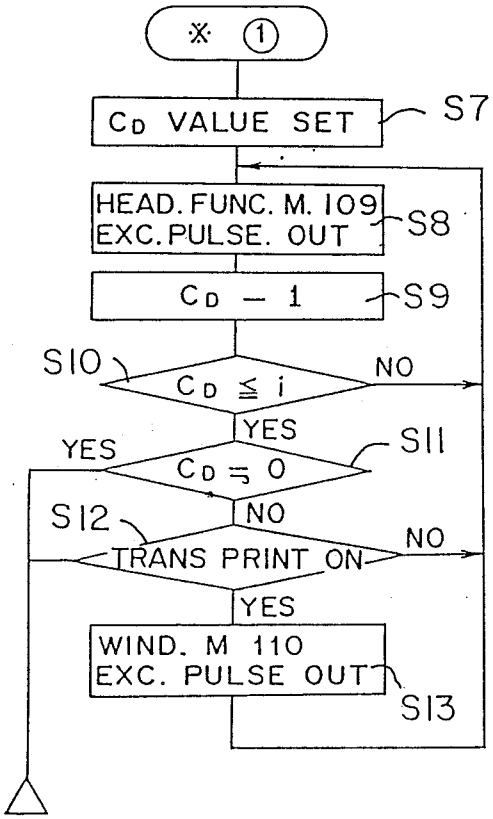
Figure 6:
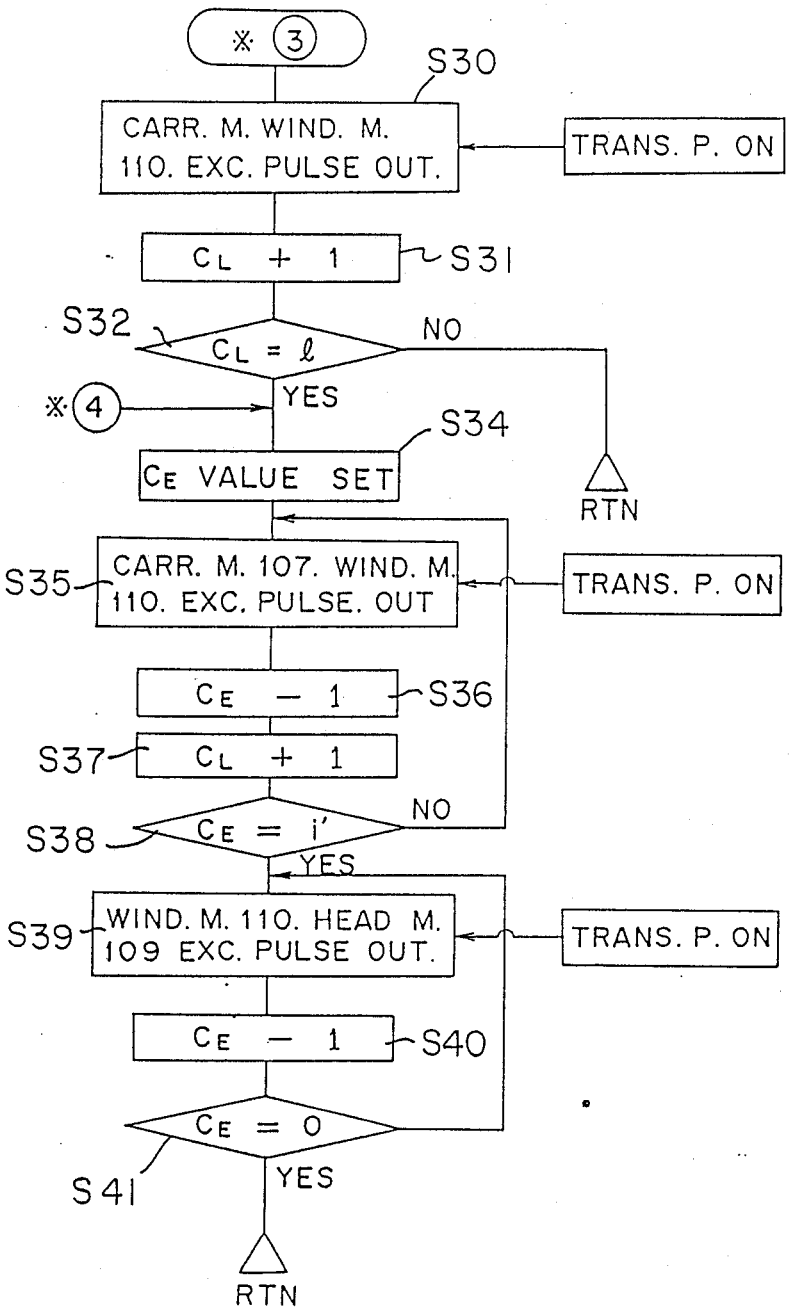
Figure 6E:
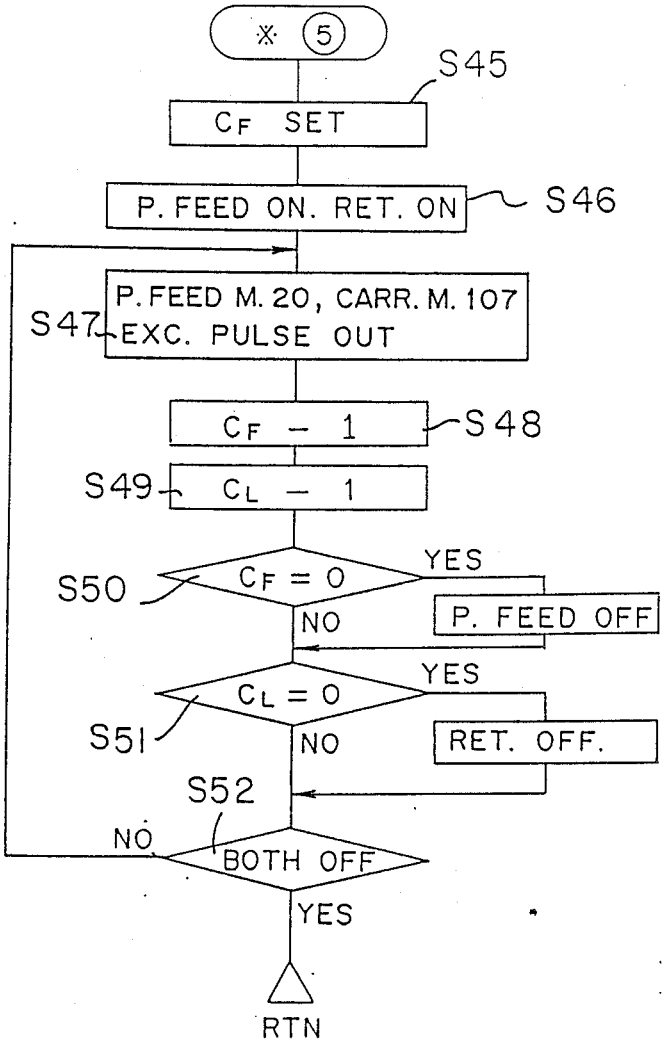

The CPU 100 effects the system control on the entire printer according to the system programs as shown in FIGS. 6(*a*) to 6(*d*) preliminarily stored in the ROM 101, which are sequentially read out by the CPU 100. The RAM 102 is subjected to control for the data read-out or write-in by the CPU 100, and this RAM 102 includes an area 102*a* for recording the recording data from a host computer 90, and various registers, counters, flags, etc. for the control formed therein. The interface device 115 is intended to effect data transmission or reception with respect to the host computer 90 such as a centro-interface, and is supplied with characters or image data equivalent to one line or predetermined lines for storing in the data area 102*a* of the RAM 102 through the system bus 103. The output I/O port 104 applies data to the respective motors (i.e., the carriage motor 107, paper feeding motor 20, head functioning motor 109 and winding motor 110) and also, to the driving circuit 111 of the thermal head 35 based on the control by the CPU 100. The input I/O port 105 takes in the signals from the ribbon end sensor 37, cassette mounting sensor 70 and other key signals (not particularly shown) for input to the CPU 100. The drive controller 106 for controlling driving of the respective motors 107, 20, 109 and 110 and the thermal head 35 applies exciting pulses of various phases to the motors 107, 20, 109 and 110 consisting of stepping motors based on the control data from the CPU 100, and also supplies respective recording dot data to the head driving circuit 111.

By the above control, the winding motor 110, carriage motor 107, and head functioning motor 109 are adapted to bring the thermal head 35 into pressure contact with the recording paper 8 by starting the head functioning motor 109 according to the starting of the recording, and before completion of the pressure contact of said thermal head 35, the winding motor 110 is driven for rotation so as to prevent the slackening of the transfer ribbon 47, and upon completion of the pressure contact of the thermal head 35, the carriage motor 107 is adapted to be driven for rotation in synchronization with the winding motor 110.

Meanwhile, the winding motor 110, carriage motor 107 and head operating motor 109 space the thermal head 35 away from the recording paper 8 by driving the head functioning motor 109 in synchronization with the rotation of the winding motor 110 according to the termination of continuous recording, while the winding motor 110 is continuously rotated until the spacing of the thermal head 35 has been completed so as to prevent the slackening of the transfer ribbon 47, and upon completion of the spacing of the thermal head 35, the rotation of the winding motor 110 is interrupted, for subsequently driving the carriage motor 107.

The head driving circuit 111 includes a shift register 111*a* having a capacity equivalent to the number of dots for the thermal head 35, and a buffer 111*b* connected in parallel with this shift register 111*a* and coupled to a switching circuit 111*c* of a group of heat generating elements 111*d*. In the thermal head 35 driven through the driving circuit 111, the heat generating elements 111*d* are arranged, for example, longitudinally in one row.

When the transfer ribbon cassette 40 is not mounted, the energizing time for the heat generating elements 111*d* is made longer than when the cassette 40 is mounted so as to increase the heat generating temperature of the thermal head 35. It is to be noted here that in order to raise the heat generating temperature of the thermal head 35, the voltage applied to the heat generating elements 111*d* may be increased instead of lengthening the energizing time therefor.

Figure 7A:
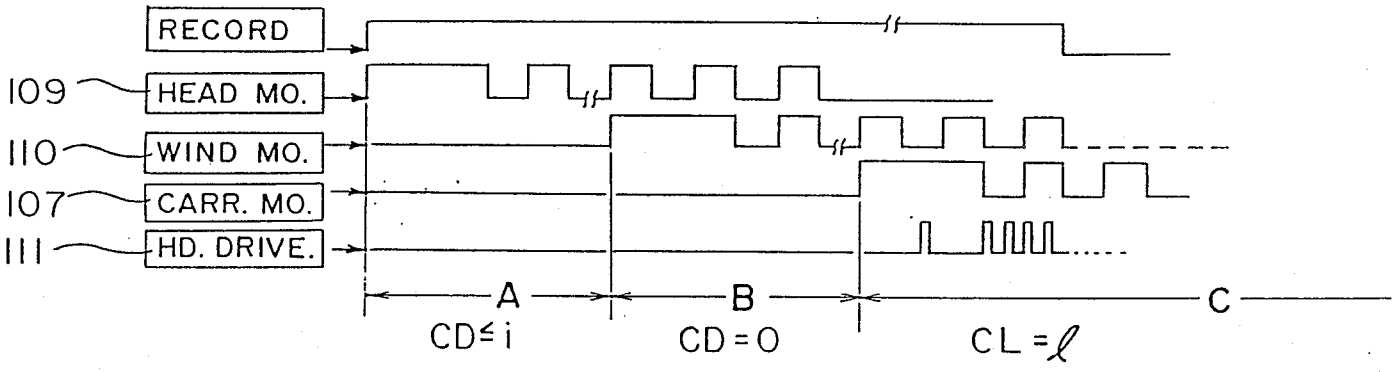
FIGS. 7(*a*) and 7(*b*) are diagrams showing correlations among driving states of respective motors for the thermal transfer printer according to the present invention.
Figure 7B:
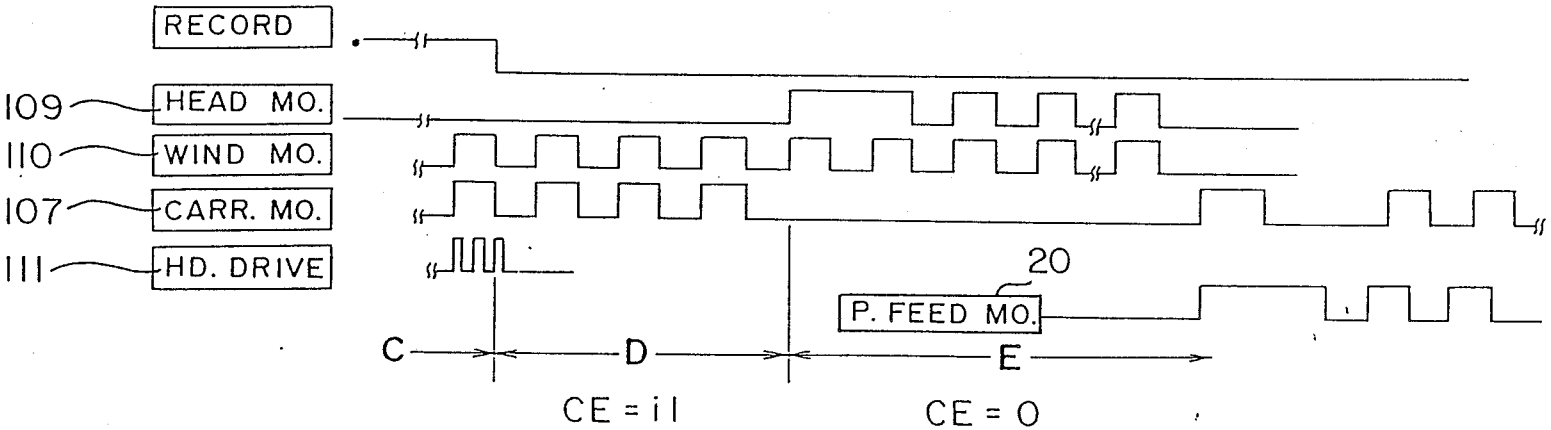

Functions FIGS. 6 and 7

Subsequently, referring particularly to FIGS. 6(*a*) through 7(*b*), functions of the thermal transfer printer of the present invention as described so far will be explained.

When data are ready, with a recording data for one line being stored in the memory data area 102*a* of the RAM 102 from the host computer 90 through the interface device 115 (FIG. 5), procedures in FIG. 6(*a*) are effected as follows to start the recording functions.

In FIG. 6(*a*), in S1 it is first checked whether the cassette mounting sensor 70 is on or off, and if it is in the off state, the mode is set for the recording of the ordinary heat sensitive paper 8, while if judged as on, the transfer print flag is set to be on in S2. Moreover, in S3 judgement is made as to whether the ribbon end sensor 37 is on or off, and if it is on, it is judged in S4 that the transfer ribbon 47 within the transfer ribbon cassette 40 has been all used up to effect the error processing, e.g., sounding of an alarm and lighting of a lamp, without carrying out the recording function. For the recording onto the heat sensitive paper 8, the heat sensing temperature is higher than that of the thermal transfer ribbon 47, and thus, in the case of the heat sensitive paper 8, it is necessary to set the heat generating temperature of the thermal head 35 to be high, and therefore, the energizing time is increased for the purpose.

Subsequently, in S5 the initial drive control of the head functioning motor 109 and the winding motor 110 is effected. By this control, the head functioning motor 109 is rotated to bring the thermal head 35 into pressure contact with the platen 14, while the winding motor 110 is rotated to apply a constant tension to the transfer ribbon 47 for removal of slackening. The above control of the winding motor 110 is effected only during the transfer print mode in S6, and does not function during the heat sensitive paper printing mode.

As shown in FIG. 6(*b*) marked with * ① as continuous from FIG. 6(*a*), the specific functions are such that in S7 a CD value equivalent to the amount of rotation until the thermal head 35 completely contacts the platen 14 is set in the counter 102*b* in the RAM 102. For the above, in S8 the head functioning motor 109 is rotated until the head slider 66 contacts the highest portion of the cylindrical cam 63 of the cam gear 62 in FIG. 2. Thereafter, also in S8, exciting pulses are fed to the head functioning motor 109 through the output I/O port 104 and the drive control 106, and further, such exciting pulses are continuously fed through counting down by "one" of the CD value in S9 until the relation $CD \leqq i$ in S10 is reached. This state is shown in FIG. 7(*a*)-A. Here, the value i is equivalent to the point in time immediately before the thermal head 35 completely contacts the platen 14, and equivalent to about 10 steps prior to actuation of the stepping motor 20. In the case of the transfer print mode, exciting pulses are fed also to the winding motor 110 from the above state as shown in S12 and S13 for repetition until the relation $CD=0$ in S11 is reached. This state is shown in FIG. 7(*a*)-B. It is to be noted here that, for each of the motors (the head functioning motor 109, winding motor 110, and carriage motor 107) in FIGS. 7(*a*) or 7(*b*), the time-chart for one phase is shown, in which the initial exciting pulse is adapted to be broader than other exciting pulses in order to increase the torque for the rising. By the above series of functions, the thermal head 35 is brought into complete pressure contact with the platen 14, while the winding spool 42 does not wind up the ribbon 47 unnecessarily, with the slackening of said ribbon 47 being simultaneously prevented.

Referring back to FIG. 6(*a*), the procedure advances to the recording function. Prior to the recording, it is judged whether or not the mode is the transfer print mode as shown in S6, and in the transfer print mode, it is checked whether the cassette mounting sensor 70 (see S14) and the ribbon end sensor 37 (see S15) are on or off, and in the case where the cassette mounting sensor 70 is off or the ribbon end sensor 37 is on, the error processing is executed in S16 to effect the returning of the carriage 30 as described later for suspending the recording function. This function is intended to interrupt the recording in the case where the cassette 40 is carelessly removed during the recording or the ribbon 47 is terminated.

If the conditions as described so far are satisfied, the recording is executed in S17, and the recorded data of the RAM 102 are read out, and the judgement of the skip command in S18 (idle feeding of the thermal head 35) and line feed (LF) command in S19 (carriage returning command) is effected. In the case of the recording data, one column of the recording data is transferred to the shift register 111*a* of the head drive circuit 111 in S20 for recording in S21 by energization of the heat generating elements 111*d* of the thermal head 35.

As illustrated in FIG. 6(*c*) marked with * ② as continuous from FIG. 6(*a*), the specific functions are such that, in the case of the transfer print mode at S22, the PL value equivalent to heat sensing temperature of the transfer print mode, the PL value equivalent to heat sensing temperature of the thermal transfer ribbon 47, is set at S23 in the counter 102*b* within the RAM 102, while, if the mode is not the transfer print mode, the PH value equivalent to the heat sensing temperature of the heat sensitive paper 8 is set therein (PL<PH) at S24. Moreover, the strobe signal is fed out to transfer the data of the shift register 111*a* to the buffer 111*b* of the head driving circuit 111 in S25, and in the heat generating elements 111*d* of the thermal head 35, the elements 111*d* in which the recording dot data are present, are energized for starting the recording. Thereafter, are energized for starting the recording. Thereafter, the PH value or PL value is counted down by "one" in S26 for repetition until the relation PH(L)=0 is reached in S27. In other words, the time for energization is determined by the value of PH(L), and upon arrival at the relation PH(L)=0, the above buffer 111*b* is reset at S28 to terminate the energization for completion of the recording.

Referring back to FIG. 6(*a*) again, upon completion of the recording by the above functions in FIG. 6(*c*), the carriage motor 107 and the winding motor 110 are controlled for rotation in S29 to displace the carriage 30 to the subsequent column position, while the amount of the ribbon 47 removed by the above displacement, in the transfer ribbon 47 held between the thermal head 35 and the platen 14, is wound up to be pulled off the recording paper 8.

The above functions continue to FIG. 6(*d*) marked with *③ as continuous from FIG. 6(*a*).

In the first place, exciting pulses are fed to the carriage motor 107 and the winding motor 110 (only during the transfer print mode) in S30. Moreover, the CL value representing the amount of displacement of the carriage 30 is counted up by "one" in S31 until C=1 in S32 (further described below). Here, exciting pulses are applied also to the winding motor 110 by the same step as that for the carriage motor 107 in order to impart a torque to the winding reel 31 to such a degree as is sufficient for separating the transfer ribbon 47 from the recording paper 8 due to the fact that, since the gear ratio of the motor gear 60 in FIG. 2, idler gear 57*a* and winding gear 57 is set to be slightly larger than that of the carriage motor gear 27 and the idler gear 26 in FIG. 1, the amount of rotation of the winding gear 57 becomes larger than the amount of displacement of the carriage 30. By the above torque, a predetermined tension is applied to the ribbon 47, while, by the frictional force of the felt member 54 under the winding gear 57, a torque larger than the pressure contact force of the thermal head 35 is absorbed so that the ribbon 47 may not be wound up unnecessarily. Therefore, the ratio in the amount of rotation of the above motors 107 and 110 during one column is not limited to 1:1, but based on the above gear ratios, the exciting pulse supply rate for the winding motor 110 may be made smaller than that for the carriage motor 107 to achieve the torque relation as described above.

Reverting to FIG. 6(*a*), the above functions are repeated until the recording equivalent to one line at S33 has been completed. In FIG. 7(*a*)-C, in the case where the recording equivalent to one line, i.e., the LF command in the recording data is read out, or the carriage 30 has been displaced up to a predetermined position, control for the remaining amount of rotation for the carriage motor 107 and the winding motor 110 is effected. This function is intended to idly feed the thermal head 35 by a predetermined amount so as to separate the transfer ribbon 47 adhering to the recording paper 8.

The above functions continue to FIG. 6(*d*) as marked with *④. When the relation CL=1 at S32 (wherein 1 is the position at the end of the line for the predetermined recording range) is reached or the LF command is read out, a CE value equivalent to the above separation or peeling-off control and the removal of slackening is set at S34 in the counter 102*b* within the RAM 102. Subsequently, exciting pulses are fed out to the carriage motor 107 and the winding motor 110 (only during the transfer print mode) in S35 so as to count down the CE value by "one" in S36, and also to count up the CL value by "one" in S37. This function is continued until arrival at the relation CE=i' in S38 (FIG. 7(*b*)-D). The above value i' is equivalent to the amount of displacement by which the recording dots are deviated from the pressure contact portion of the thermal head 35, and is equivalent to about 10 dots. Thereafter, the carriage motor 107 is stopped and exciting pulses are fed out to the winding motor 110 (only during the transfer print mode) and the head functioning motor 109 at S39, the CE value is counted down by "one" in S40 until arrival at the relation CE=0 (FIG. 7(*b*)-E) in S41. In this case, since the head slider 66 directly contacts the lowest portion of the cam protrusion of the cylindrical cam 63, the thermal head 35 is momentarily spaced from the platen 14 so as to be subsequently rotated up to a home position of the cylindrical cam 63, and in this case, the winding motor 110 is rotated to remove the slackening amount.

It should be noted here that in the above series of functions, although the carriage 30 is displaced by the amount equivalent to the separation, the function for E may be directly effected without effecting the above function. In this case, however, there is a possibility that the ribbon 47 is taken out from the supply spool 41 more than necessary, since the winding motor 110 applies a torque equivalent to the separating force, thus inviting such problems that the adjustments of the degree of tension of the supply reel 32, and of the winding torque become complicated.

Referring back to FIG. 6(*a*), rotation control of the carriage motor 107 and the paper feeding motor 20 is subsequently effected in S42, and thus, the returning function of the carriage 30 and feeding of the predetermined amount of the recording paper 8 are completed in S43.

More specifically, the function continues to FIG. 6(*e*) as marked with *⑤, and the exciting pulses in the opposite phase are supplied to the carriage motor 107 in S44 until the CL value reaches zero, while exciting pulses equivalent to the predetermined paper feeding amount CF value are fed to the paper feeding motor 20.

In other words, the predetermined paper feeding value is set as $C_F$ SET in S45 and the paper feed and carriage return function of paper feed motor 20 and carriage motor 107 are "ON", respectively, in S46. With both of these motors "ON", exciting pulses are fed out to these motors in S47 so as to count down the $C_F$ value by "one" in S48 and to count down the $C_L$ value by "one" in S49. These functions are continued until the paper feed value is zero (i.e. $C_F=0$) at S50 thereby turning the paper feed OFF until arrival at the relation $C_L=0$ in S51 thereby turning the carriage return function of the carriage return motor OFF. The process continues until both motors are OFF as in S52.

Reverting again to FIG. 6(*a*), when the skip command is read out from the recording data, the control for the remaining rotation for the carriage motor 107 and winding motor 110, and the terminating rotation control of the head functioning motor 109 and the winding motor 110 are effected according to the flow-chart of FIG. 6(*d*).

Thereafter, exciting pulses are fed to the carriage motor 107 so as to displace the carriage 30 by the number of skips read out as the recording data, and thus, the thermal head 35 is idly fed without recording the non-recording region (space) and without effecting the winding.

As is clear from the foregoing description, in the thermal transfer printer according to the present invention, since the winding motor 110 for driving the transfer ribbon winding unit 56 in synchronization with the carriage 30 is provided on the carriage 30 separately from the carriage motor 107 for displacing said carriage 30, the load to be applied to the carriage motor 107 is advantageously reduced therefore requiring only a compact size motor 107. Moreover, since the engaging mechanism between the carriage scanning mechanism and the transfer ribbon winding unit 56 becomes unnecessary, there are such advantages that not only the mechanism is simplified, but adjustment of such engaging mechanism is not required. Meanwhile, by effecting the winding of the ribbon 47 by the winding motor 110 in synchronization with the printing, stable feeding of the transfer ribbon 47 may be effected. Furthermore, since driving of the winding motor 110 is made impossible except for during the transfer print mode, noises arising from idle rotation of the winding reel 31 are lowered, while loss of electric power can be reduced. The thermal transfer printer of the present invention may be applied to a color printer having various color components in a serial form.

Meanwhile, according to the thermal transfer printer of the present invention, owing to the arrangement that the means for detecting the presence or absence of the transfer ribbon cassette 40 as mounted, i.e., cassette detecting means 38,70 is provided so as to control the ribbon winding motor 110 according to the result of detection by said detecting means 38,70, the driving of the winding motor 110 is automatically suspended during non-mounting as in the case where the cassette 40 is carelessly dismounted, while when non-mounting of the cassette 40 is detected, the error display (see FIG. 6*a*) is effected to make other motors also inoperable without starting of the recording function, and thus, non-mounting of the cassette 40 may be quickly noticed.

Moreover, in the thermal transfer printer of the present invention, the heat generating temperature of the thermal head 35 is changed over for control according to the result of detection by the cassette detecting means 38,70, whereby the heat generating temperature of the therm head 35 is set to be lower in the transfer print mode employing the transfer ribbon 47 than that in the recording mode onto the heat sensitive paper 8, and thus, it is possible to adjust the heat generating temperature of the thermal head 35 to an optimum level according to each mode. Owing to the arrangement that the engaging mechanism between the carriage scanning mechanism and the transfer ribbon winding means is made unnecessary by providing the ribbon winding motor 110 separately from the carriage motor 107, it is not required to release the engagement of such engaging mechanism during recording onto the heat sensitive paper 8, and thus, the construction and function are simplified.

Furthermore, according to the thermal transfer printer of the present invention, since it is so arranged that the thermal head 35 is brought into pressure contact with the recording paper 8 through driving the functioning motor 109 of the thermal head 35 according to the starting of the recording by the control circuit (see FIG. 5), with the winding of the transfer ribbon 47 being effected before completion of the pressure contact, i.e., by rotating the winding motor 110 in the course of the function for the pressure contact, slackening of the transfer ribbon 47 at the starting of the recording can be prevented.

Additionally, owing to the arrangement that the thermal head 35 is spaced away from the recording paper 8 by driving the thermal head functioning motor 109 in synchronization with the winding motor 110 according to the completion of the continuous recording through the control circuit means (see FIG. 5), while the winding motor 110 is continuously rotated until completion of the spacing to wind up the transfer ribbon 47 so as to stop rotation of the winding motor 110 after completion of said spacing of the thermal head 35, the transfer ribbon 47 is also prevented from slackening.

Although the present invention has been fully described by way of example with reference to the accompanying drawings, it is to be noted here that various changes and modifications will be apparent to those skilled in the art. Therefore, unless otherwise such changes and modifications depart from the scope of the present invention, they should be construed as being included therein.

What is claimed is:

1. A thermal transfer printer comprising:

a carriage having a ribbon supply reel and a ribbon winding reel for supporting a thermal transfer ribbon, and a thermal head for transferring data to a recording medium through said thermal transfer ribbon by heat generation, said carriage being displaced transversely across a recording medium by a carriage motor;

a transfer ribbon cassette detachably mounted on said carriage, said cassette including a ribbon supply spool and a ribbon winding spool respectively engaged with said ribbon supply reel and said ribbon winding reel, the thermal transfer ribbon passing around said supply spool and said winding spool;

cassette detecting means, provided on said carriage, for detecting said transfer ribbon cassette;

a winding motor, provided independently of said carriage motor, for selectively driving said ribbon winding reel in synchronization with said carriage motor, said winding motor being responsive to said cassette detecting means for enabling rotation of said ribbon winding reel only when said transfer ribbon cassette is detected;

means for selectively impressing said thermal head against said recording medium;

said means for selectively impressing said thermal head against said recording medium being operative at the start of recording, and said winding motor beginning rotation of said ribbon winding reel before said means for selectively impressing said thermal head against said recording medium, said carriage motor and said winding motor being driven in synchronization with each other upon impressing said thermal head against said recording medium;

said means for selectively impressing said thermal head being further for spacing said thermal head from said recording medium upon completion of recording, said carriage motor terminating rotation and said winding motor continuously rotating said ribbon winding reel until completion of the spacing of said thermal head from said recording medium and being stopped upon completion of said spacing, said carriage motor being continuously driven thereafter.

2. The thermal transfer printer according to claim 1, wherein said means for selectively impressing is operative in response to a control circuit which directs the continuous rotation of said ribbon winding reel by said winding motor until said thermal head is completely spaced from said recording medium, said control circuit continuing the operation of said carriage motor subsequent to said thermal head being completely spaced from said recording medium.

3. A thermal transfer printer according to claim 1, further comprising a control means for changing-over heat generating temperatures of said thermal head according to the detection by said cassette detecting means, so as to set the heat generating temperature of said thermal head during a transfer recording period mounted with said cassette, lower than that during a recording period onto a heat sensitive recording medium, not mounted with said cassette.

* * * * *